US008721031B2

(12) United States Patent
Snyder et al.

(10) Patent No.: US 8,721,031 B2
(45) Date of Patent: May 13, 2014

(54) SYSTEM AND METHOD FOR ANALYZING IMAGES DEPOSITED ON AN IMAGE RECEIVING MEMBER OF A PRINTER

(75) Inventors: Trevor J. Snyder, Newberg, OR (US); David D. Martenson, Oregon City, OR (US); David L. Knierim, Wilsonville, OR (US); Ernest I. Esplin, Sheridan, OR (US); James B. Campbell, Beaverton, OR (US)

(73) Assignee: Xerox Corporation, Norwalk, CT (US)

( * ) Notice: Subject to any disclaimer, the term of this patent is extended or adjusted under 35 U.S.C. 154(b) by 53 days.

(21) Appl. No.: 13/595,082

(22) Filed: Aug. 27, 2012

(65) Prior Publication Data

US 2014/0055519 A1 Feb. 27, 2014

(51) Int. Cl.
*B41J 29/393* (2006.01)

(52) U.S. Cl.
USPC ..... 347/19; 347/16

(58) Field of Classification Search
USPC ..... 347/5, 16, 19
See application file for complete search history.

(56) References Cited

U.S. PATENT DOCUMENTS

| | | | | |
|---|---|---|---|---|
| 7,510,256 | B2 | 3/2009 | Guarino et al. | |
| 7,537,304 | B2 * | 5/2009 | Wu et al. | 347/19 |
| 7,810,896 | B2 | 10/2010 | Mizes et al. | |
| 7,980,650 | B2 | 7/2011 | Zhang et al. | |
| 8,052,244 | B2 | 11/2011 | Ruff et al. | |
| 2011/0279503 | A1 | 11/2011 | Mizes et al. | |

* cited by examiner

*Primary Examiner* — Juanita D Jackson
(74) *Attorney, Agent, or Firm* — Maginot, Moore & Beck, LLP

(57) ABSTRACT

A method and apparatus for analyzing images deposited on an image receiving member of a printer, and more particularly analyzing images deposited on a surface of an imaging drum in an inkjet printer. A photoelectric sensor supported by a sled in contact with the surface of the imaging drum can be used to detect missing jets in the printhead, to align the printhead, to reduce the amount of purged ink, and to determine run out of the imaging drum.

11 Claims, 6 Drawing Sheets

SYSTEM AND METHOD FOR ANALYZING IMAGES DEPOSITED ON AN IMAGE RECEIVING MEMBER OF A PRINTER

TECHNICAL FIELD

This disclosure relates generally to a method and apparatus for analyzing images deposited on an image receiving member of a printer, and more particularly to analyzing images deposited on a surface of an imaging drum in an inkjet printer using an imaging sled configured to move along the surface of an imaging drum.

BACKGROUND

Inkjet printers operate a plurality of inkjets in each printhead to eject liquid ink onto an image receiving member. The ink can be stored in reservoirs that are located within cartridges installed in the printer. Such ink can be aqueous ink or an ink emulsion. Other inkjet printers receive ink in a solid form and then melt the solid ink to generate liquid ink for ejection onto the image receiving surface. In these solid ink printers, also known as phase change inkjet printers, the solid ink can be in the form of pellets, ink sticks, granules, pastilles, or other shapes. The solid ink pellets or ink sticks are typically placed in an ink loader and delivered through a feed chute or channel to a melting device, which melts the solid ink. The melted ink is then collected in a reservoir and supplied to one or more printheads through a conduit or the like. Other inkjet printers use gel ink. Gel ink is provided in gelatinous form, which is heated to a predetermined temperature to alter the viscosity of the ink so the ink is suitable for ejection by a printhead. Once the melted solid ink or the gel ink is ejected onto the image receiving member, the ink returns to a solid, but malleable form, in the case of melted solid ink, and to a gelatinous state, in the case of gel ink.

A typical inkjet printer uses one or more printheads with each printhead containing an array of individual nozzles through which drops of ink are ejected by inkjets across an open gap to an image receiving surface to form an ink image during printing. The image receiving surface can be the surface of a continuous web of recording media, a series of media sheets, or the surface of an image receiving member, which can be a rotating print drum or endless belt.

In an inkjet printhead, individual piezoelectric, thermal, or acoustic actuators generate mechanical forces that expel ink through an aperture, usually called a nozzle, in a faceplate of the printhead. The actuators expel an ink drop in response to an electrical signal, sometimes called a firing signal. The magnitude, or voltage level, of the firing signals affects the amount of ink ejected in an ink drop. The firing signal is generated by a printhead controller with reference to image data. A print engine in an inkjet printer processes the image data to identify the inkjets in the printheads of the printer that are operated to eject a pattern of ink drops at particular locations on the image receiving surface to form an ink image corresponding to the image data. The locations where the ink drops landed are sometimes called "ink drop locations," "ink drop positions," or "pixels." Thus, a printing operation can be viewed as the placement of ink drops on an image receiving surface with reference to electronic image data.

Phase change inkjet printers form images using either a direct or an offset print process. In a direct print process, melted ink is jetted directly onto recording media to form images. In an offset print process, also referred to as an indirect print process, melted ink is jetted onto a surface of a rotating member such as the surface of a rotating drum, belt, or band. Recording media are moved proximate the surface of the rotating member in synchronization with the ink images formed on the surface. The recording media are then pressed against the surface of the rotating member as the media passes through a nip formed between the rotating member and a transfix roller. The ink images are transferred and affixed to the recording media by the pressure in the nip. This process of transferring an image to the media is known as a "transfix" process.

Indirect inkjet printers are capable of producing either simplex or duplex prints. Simplex printing refers to production of an image on only one side of a print media. Duplex printing produces an image on each side of a media sheet. In duplex indirect printing, an ink image is initially formed on an intermediate drum and then transferred to the media. The media sheet is then inverted and sent along a path that passes the second side of the media sheet by the intermediate drum upon which the ink has been deposited for the formation of a second ink image on the second side.

In order for the printed images to correspond closely to the image data, both in terms of fidelity to the image objects and the colors represented by the image data, the printheads can be registered with reference to the image receiving surface and with the other printheads in the printer. Registration of printheads is a process in which the printheads eject ink in a known pattern and the printed known pattern is analyzed to determine the orientation of the printhead with respect to the imaging surface and with respect to the other printheads in the printer. The proper orientation of the printheads, however, is often verified. Additionally, verification of the proper operation of the inkjet ejectors can be made by an analysis of a printed image. The analysis generates data that is used to adjust the position of the printheads or the operation of the printheads to compensate for deviations of the printheads from the presumed conditions.

Analysis of printed images is performed with reference to two directions. "Process direction" refers to the direction in which the image receiving member is moving as the image receiving surface passes the printhead. "Cross-process direction" refers to the direction substantially perpendicular to the process direction, typically across a width of the image receiving member. In order to analyze a printed image, a test pattern is generated on the image receiving member to determine whether the actuated inkjets ejected ink and whether the ejected ink landed at a correct location, assuming the proper orientation of the printhead with the image receiving member and other printheads in the printer.

In some printing systems, a printed image is scanned with a flatbed scanner or other known offline imaging device to determine the operation of the printhead. This method of generating a picture of the printed image with an offline imaging device suffers from analyzing the printed image in situ and from inaccuracies imposed by the imaging device. In some printers, a scanner is integrated into the printer and analyzes the image while within the printer. These integrated scanners typically include one or more illumination sources and one or more optical sensors that receive radiation from the illumination source that has been reflected from the image receiving surface. Each optical sensor generates an electrical signal that corresponds to the intensity of the reflected light received by the sensor. The electrical signals from the optical sensors can be converted to digital signals by analog/digital converters and provided as digital image data to an image processor.

SUMMARY

A printer includes a rotating image receiving member having a substantially cylindrical outer surface disposed between a first end and a second end. The printer further includes a printhead disposed adjacent to the image receiving member which is configured to form an ink image on the surface thereof. A movable member, disposed at the first end of the rotating image receiving member, is configured to move from the first end to the second end and back to the first end. A photoelectric sensor, operatively connected to the movable member, is configured to receive transmitted light reflected from an ink image, and to convert the reflected transmitted light to a first signal representative of the reflected transmitted light.

A printer to form an ink image on recording media includes an imaging surface, a printhead, and an imaging sled. The printhead is disposed adjacent to the imaging drum to form an ink image on the imaging surface. The imaging sled is configured to contact the imaging surface to generate an image signal representative of an ink image formed on the imaging surface and to generate a location signal representative of the location of the imaging sled on the imaging surface.

A method determines the location of an inoperative inkjet nozzle in an offset phase change inkjet printer having a printhead with a plurality of inkjet nozzles depositing ink on an imaging drum having a first end and a second end. The method includes depositing ink on the imaging drum, scanning the deposited ink with a photoelectric sensor moving in a first direction from the first end to the second end of the imaging drum, and scanning the deposited ink with the photoelectric sensor moving in a second direction from the second end to the first end of the imaging drum.

BRIEF DESCRIPTION OF THE DRAWINGS

The foregoing aspects and other features of an inkjet printer having an image receiving member are explained in the following description, taken in connection with the accompanying drawings.

DETAILED DESCRIPTION

Figure 1:
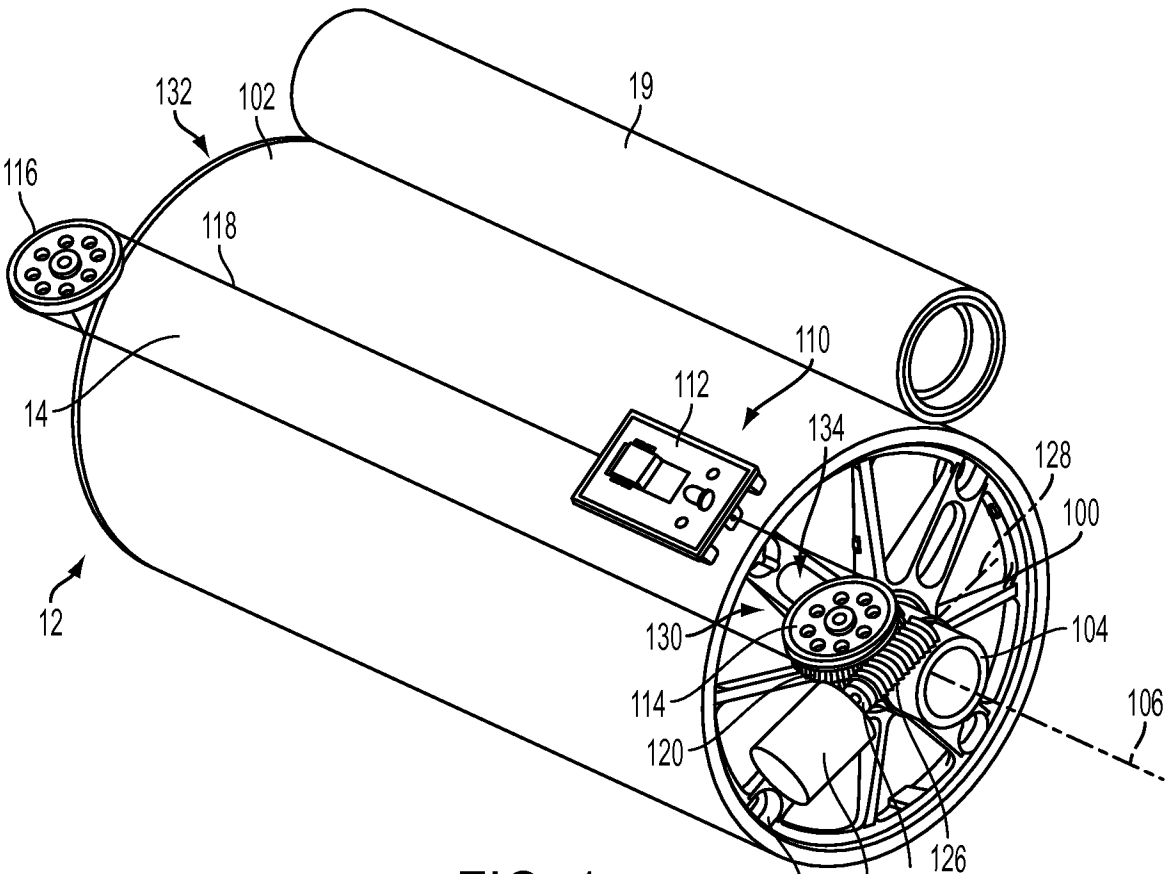
FIG. 1 is a perspective view of a transfix roller disposed adjacent to an imaging drum and including a photoelectric sensor and drive mechanism configured to move an imaging sled across an image receiving surface of the imaging drum.

For a general understanding of the environment for the system and method disclosed herein as well as the details for the system and method, the drawings are referenced throughout this document. In the drawings, like reference numerals designate like elements. As used herein the term "printer" or "printing system" refers to any device or system that is configured to eject a marking agent upon an image receiving member and includes photocopiers, facsimile machines, multifunction devices, as well as direct and indirect inkjet printers and any imaging device that is configured to form images on a print medium.

Figure 6:
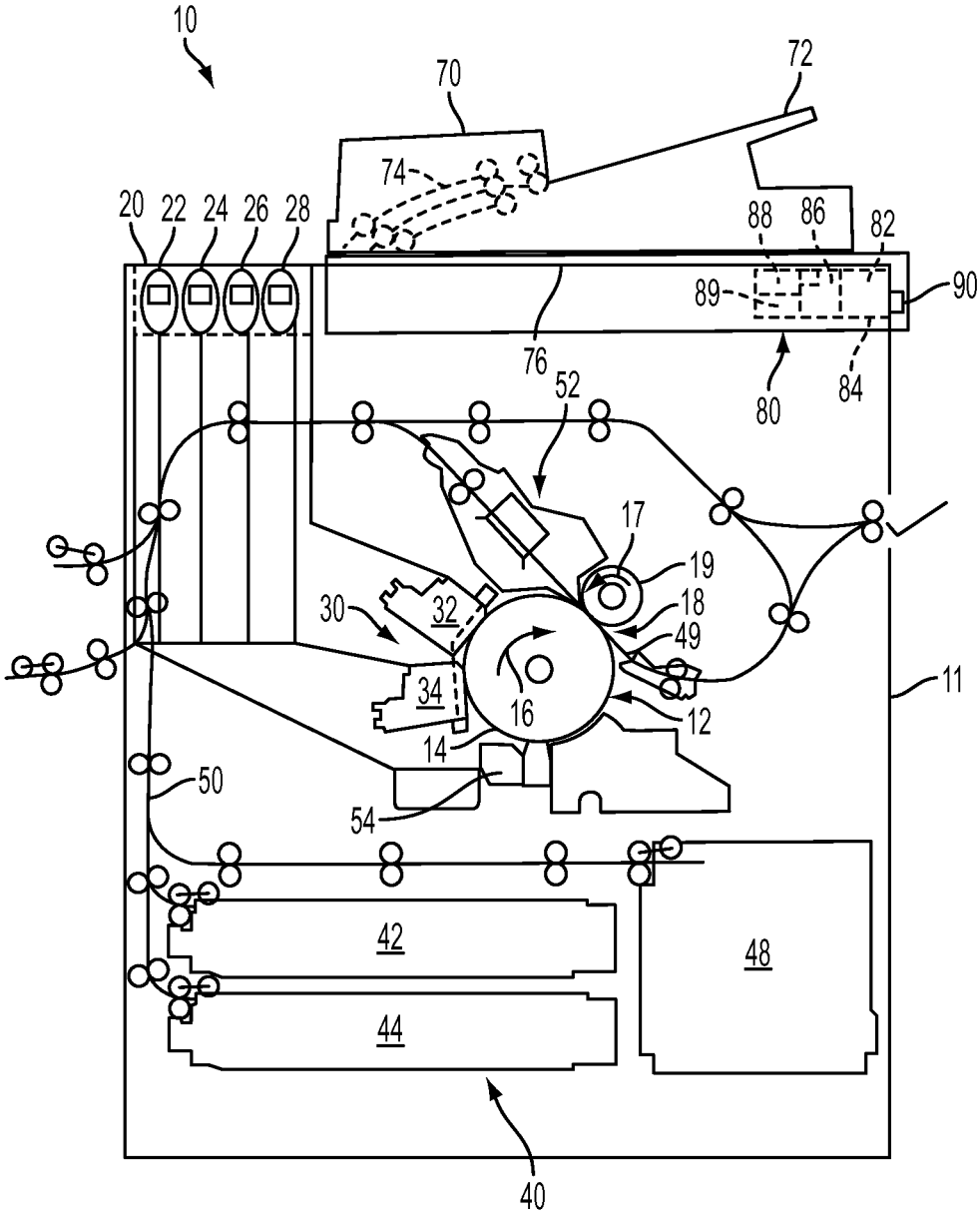
FIG. 6 PRIOR ART
FIG. 6 is a schematic view of an inkjet printer configured to print images onto a rotating image receiving member and to transfer the images to recording media.

FIG. 6 illustrates a prior art inkjet printer 10 having elements pertinent to the present disclosure. In the embodiment shown, the printer 10 implements a solid ink print process for printing onto sheets of recording media. Although the inkjet printer and inkjet printheads are described below with reference to the printer 10 depicted in FIG. 6, the subject method and apparatus disclosed herein can be used in any printer, continuous web inkjet printer or cartridge inkjet printers, having printheads which eject ink directly onto a web image substrate or sheets of recording media.

The inkjet printer 10 is a high-speed phase change ink image producing machine or printer. As illustrated, the printer 10 includes a frame 11 supporting directly or indirectly operating subsystems and components, as described below. The printer 10 includes an image receiving member 12 that is shown in the form of an imaging drum, but can also include an imaging belt or band each having imaging surfaces, and each of which can be an endless belt or band. The image receiving member 12 has an imaging surface 14 that is movable in a direction 16, and on which phase change ink images are formed. A transfix roller 19 rotatable in the direction 17 is loaded against the surface 14 of drum 12 to form a transfix nip 18, within which ink images formed on the surface 14 are transfixed onto a recording media 49, such as a heated media sheet.

The high-speed phase change ink printer 10 also includes a phase change ink delivery subsystem 20 that has at least one source 22 of one color phase change ink in solid form. Since the phase change ink printer 10 is a multicolor image producing machine, the ink delivery system 20 includes four (4) sources 22, 24, 26, 28, representing four (4) different colors CYMK (cyan, yellow, magenta, black) of phase change inks. The phase change ink delivery system 20 is suitable for supplying the liquid form to a printhead system 30 including at least one printhead assembly 32. Each printhead assembly 32 includes at least one printhead configured to eject ink drops onto the surface 14 of the image receiving member 12 to produce an ink image thereon. Since the phase change ink printer 10 is a high-speed, or high throughput, multicolor image producing machine, the printhead system 30 includes multicolor ink printhead assemblies and a plural number (e.g., two (2)) of separate printhead assemblies 32 and 34 as shown, although the number of separate printhead assemblies can be one or more.

As further shown, the phase change ink printer 10 includes a recording media supply and handling system 40, also known as a media transport. The recording media supply and handling system 40 can include sheet or substrate supply sources 42, 44, 48, of which supply source 48, for example, is a high capacity paper supply or feeder for storing and supplying image receiving substrates in the form of cut media sheets 49. The recording media supply and handling system 40 also includes a substrate handling and treatment system 50 that has a substrate heater or pre-heater assembly 52. The phase change ink printer 10 as shown can also include an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80 is operably connected to the image receiving member 12, the melting and control apparatus 20, the printhead assemblies 32, 34 (and thus the printheads), and the substrate supply and handling system 40. The ESS or controller 80, for example, is a self-contained, dedicated mini-computer having a central processor unit (CPU) 82 with electronic storage 84, and a display or user interface (UI) 86. A temperature sensor 54 is operatively connected to the controller 80. The temperature sensor 54 is configured to measure the temperature of the image receiving member surface 14 as the image receiving member 12 rotates past the temperature sensor 54. In one embodiment, the temperature sensor is a thermistor that is configured to measure the temperature of a selected portion of the image receiving member 12. The controller 80 receives data from the temperature sensor and is configured to identify the temperatures of one or more portions of the surface 14 of the image receiving member 12.

The ESS or controller 80 can include a sensor input and control circuit 88 as well as a pixel placement and control circuit 89. In addition, the CPU 82 reads, captures, prepares and manages the image data flow between image input sources, such as the scanning system 76, or an online or a work station connection 90, and the printhead assemblies 32 and 34. As such, the ESS or controller 80 is the main multitasking processor for operating and controlling all of the other machine subsystems and functions, including the printing process discussed below.

The controller 80 can be implemented with general or specialized programmable processors that execute programmed instructions. The instructions and data required to perform the programmed functions can be stored in memory associated with the processors or controllers. The processors, associated memories, and interface circuitry configure the controllers to perform the processes that enable the printer to perform heating of the image receiving member, depositing of the ink, and drum maintenance unit cycles. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in very large scale integration (VLSI) circuits. Also, the circuits described herein can be implemented with a combination of processors, ASICs, discrete components, or VLSI circuits. Additionally, the controller 80 determines and/or accepts related subsystem and component controls, for example, from operator inputs via the user interface 86, and accordingly executes such controls. As a result, appropriate color solid forms of phase change ink are melted and delivered to the printhead assemblies 32 and 34. In addition, the operator can execute the purging of one or more printheads, as described herein, through an input command made at the user interface. In some printing operations, a single ink image can cover the entire surface of the imaging member 12 (single pitch) or a plurality of ink images can be deposited on the imaging member 12 (multi-pitch). Furthermore, the ink images can be deposited in a single pass (single pass method), or the images can be deposited in a plurality of passes (multi-pass method). In a multi-pitch printing architecture, the surface of the image receiving member is partitioned into multiple segments, each segment including a full page image (i.e., a single pitch) and an interpanel zone or space. For example, a two pitch image receiving member 12 is capable of containing two images, each corresponding to a single sheet of recording medium, during a revolution of the image receiving member 12. Likewise, for example, a three pitch intermediate transfer drum is capable of containing three images, each corresponding to a single sheet of recording medium, during a pass or revolution of the image receiving member 12.

Once an image has been formed on the image receiving member 12 under control of the controller 80 in accordance with an imaging method, the exemplary inkjet printer 10 converts to a process for transferring and fixing the image or images at the transfix roller 19 from the image receiving member 12 onto a recording medium 49. According to this process, a sheet of recording medium 49 is transported by a transport under control of the controller 80 to a position adjacent the transfix roller 19 and then through a nip formed between the transfix roller 19 and image receiving member 12. The transfix roller 19 applies pressure against the back side of the recording medium 49 in order to press the front side of the recording medium 49 against the image receiving member 12.

FIG. 1 is perspective view of the transfix roller 19 disposed adjacent to the imaging drum 12. The imaging drum 12 includes a plurality of spokes 100 which engage each end of a cylinder 102. The plurality of spokes 100 are operatively connected to a hub 104. Each end of the drum 12 can be open and supported by the hub 104 and the plurality of spokes 100. The hub 104 can include a pass through for passage of electrical wires, if required, within the drum. Additionally; a bearing, not shown, is used on the outside of the hub 104 to enable rotational movement of the cylinder 102 about a rotational axis 106 defined along a longitudinal axis of the hub 104. The spokes 100 extend from the hub 104 to support the cylinder 102 of the drum 12 and provide airways for air circulation within the drum 12.

A photoelectric sensor device 110 includes an imaging sled 112, a first and second pulley 114 and 116 respectively, and a length of material 118, such as a line, cord, or cable, belt or string which engages the first pulley 114 and the second pulley 116. The device 110 further includes a gear 120, operatively connected to the first pulley 114, which is driven by a motor 122 supported by a supporting structure (not shown) of the printer. The motor 122 includes a shaft 124 supporting a gear 126 for rotational movement about an axis 128. The length of material 118 can be made of a variety of materials which include the characteristics of flexibility and inelasticity. The drive mechanism, including the motor 122, can include a number of different types of electric motors such as AC, DC, and stepping motors. In addition, the drive mechanism including the motor 122 need not be a precision drive mechanism to move the imaging sled since many overlapping images can be acquired by the controller and stitched together to form a complete image of a test pattern. In addition, while a drive mechanism having a motor and a first and second pulley is described, other types of drive mechanisms can be used to move the sled such as a motor driven leadscrew and a rack and pinion drive.

The imaging sled 112 is operatively connected to the line 118 and moves across the surface 14 of the drum in response to driven movement of the first pulley 114 by the motor 122. The imaging sled 112 can move from a first end 130 to a second end 132, and locations therebetween, of the cylinder 102 to image the surface 14 as well as to image an ink image deposited on the surface 14 of the drum 12. In addition, to moving from the first end 130 to the second end 132 and back from the second end to the first end 130, the imaging sled 112 can be moved entirely off of the surface 14 of the drum 12 to a location 134 disposed between the first end 130 and the first pulley 112. While not illustrated, the described embodiment can include a station or platform upon which the imaging sled 112 can be located for support when the imaging sled 112 is moved off of the surface 14 of the drum 12. The motor 122 is operatively connected to the controller 80. The motor 122 moves the imaging sled into and out of engagement with the surface 14 of the drum 12 in response to signals provided by the controller 80.

As previously described, ink is deposited on the imaging surface 14, which can include an oil coated drum, and then transferred onto the paper in an offset solid ink printing process. Because the ink is built up on the drum, the imaging sled 112 can determine the locations of the ink drops being deposited on the drum. By moving the imaging sled 112 across the drum 12 in the cross-process direction, the imaging sled 112 can scan the surface 14 of the drum 12 and the ink which has been deposited on the surface. The imaging sled 112 includes at least one sensor to provide an image of the surface of the drum and/or the ink deposited on the drum. As used herein, depositing ink the imaging surface can include depositing ink on the surface of the drum having ink or the drum not having ink.

The imaging sled 112 can detect missing jets in the printhead and can be used to align adjacent print heads in an inkjet printer having multiple printheads. In addition, scanning an ink image, such as a test pattern with the imaging sled 112 can provide alignment information and performance information for a full width array printhead in an inkjet printer. In addition, alignment of the ink droplets from adjacent inkjets in the process direction can be determined. Many other defects and alignments can be corrected which are known to those skilled in the art. One unique attribute of the described embodiments is the ability to scan the entire width of the imaging drum with the same sensor elements. For example, prior ink on drum (IOD) scanning systems used long arrays with multiple sensors. In this arrangement different sensors are used across the width of the calibration image. It is well known that these different sensor elements have significant noise. For many attributes, this sensor noise is very large compared to the signal being measured. For example, traditional "intensity banding" or "color banding" is difficult to measure using long sensor arrays. However, in the described embodiments the exact same sensors are used to measure across the width of the image. This removes the sensor to sensor sensitivity and allows for an enhanced ability to measure and correct certain page wide defects such as banding.

Inkjet printhead technology includes a very large number of inkjets, it can be difficult, if not impossible, to consistently and properly eject ink from each and every inkjet nozzle when required. Even though the printhead is manufactured to deposit ink from every inkjet in response to a command signal, the printing environment can cause one or more of the inkjets to fail on a daily basis. For instance, the printer can be operated at a reduced power during the night or even turned off at night in order to meet energy saving requirements. Once the printer resumes to an operating temperature for printing, the inkjets of the printhead are purged to clear the inkjets of air bubbles. Under these conditions, however, some of the inkjets may not clear after one purge and additional purges of ink can be required to clear all of the inkjets.

To improve printing and to reduce the amount of ink needed to purge a printhead, the imaging sled 112 can be used to detect and identify one or more missing inkjets by imaging a test image deposited on the surface 14. After identification of the missing inkjet or inkjets, the controller 80 can modify a printing algorithm to substantially hide the missing inkjet (s). By modifying the printing algorithm, the resulting image can still include sufficient detail and accuracy since printing anomalies can be masked by the modified printing algorithm. Likewise, the amount of ink needed to purge the printhead after periods of inactivity or otherwise, can be reduced by requiring fewer purges since missing inkjets can be masked with the printing algorithm. In some cases, a significant amount of ink can be saved.

Figure 2:
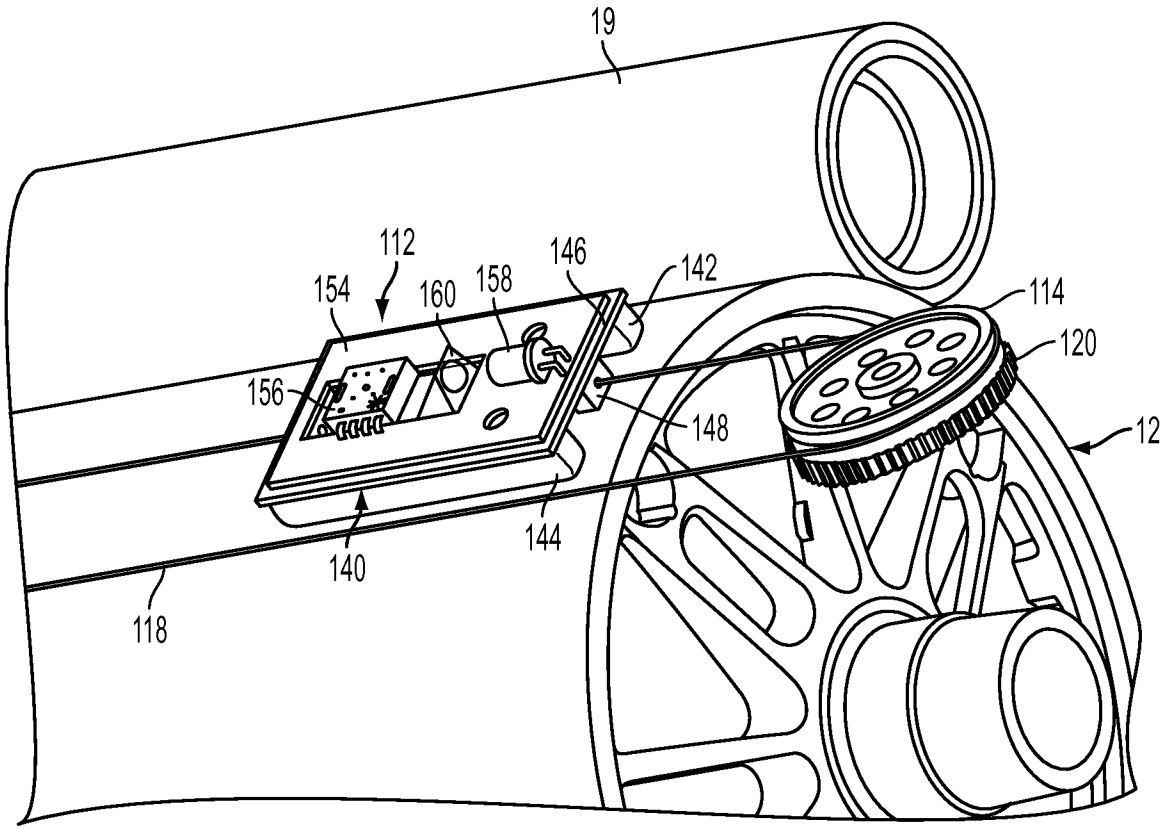
FIG. 2 is a partial perspective view of the imaging drum of FIG. 1 including the imaging sled operatively connected to a pulley of a pulley system.

FIG. 2 illustrates a partial perspective view of the imaging drum of FIG. 1 including the imaging sled 112 operatively connected to the pulley 114. The imaging sled 112 includes a base portion 140 including a first runner 142 and a second runner 144 operatively connected to a deck 146 which spans the first runner 142 and the second runner 144. A first projection 148 is operatively connected to an end of the deck 146. A second projection 150, not shown in FIG. 2, is located at a second end of the deck opposite the end operatively connected to the first projection 148. The line 118 is fixed to the first and second projections 148 and 150 such that rotational movement of the pulley 114 driven by the gear 120 and worm gear 126 moves the imaging sled 112 across the surface 14 of the drum 12.

Figure 3:
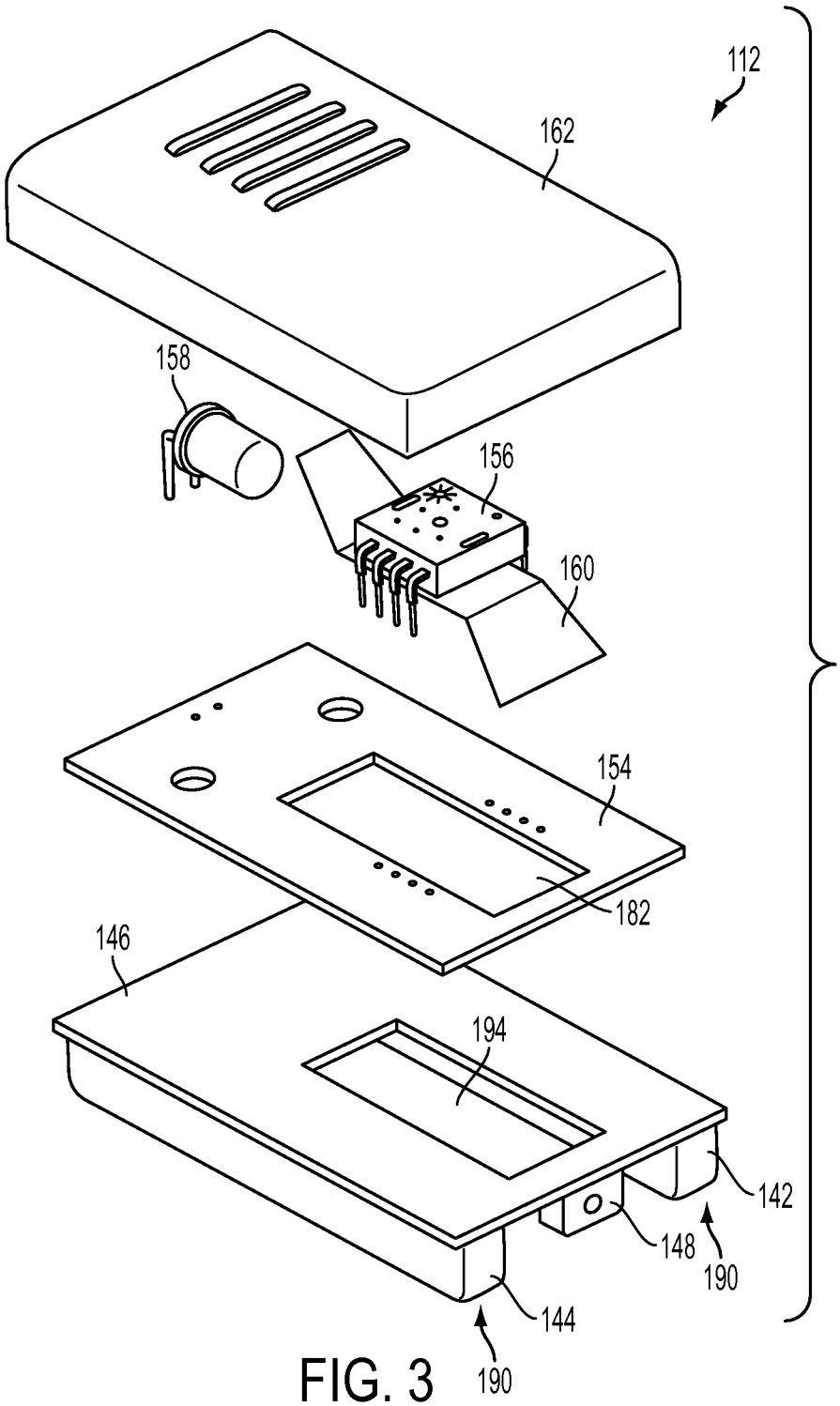
FIG. 3 is an exploded perspective view of the imaging sled of FIG. 2.

The deck 146 supports a circuit board 154 which includes an imaging circuit 156 and an illumination device 158. The illumination device 158 is disposed on the circuit board 154 to direct light to the surface 14 of the drum 12 by a lens reflector 160. FIG. 3 illustrates an exploded view of the imaging sled 112 including the base portion 140, the circuit board 154, the imaging circuit 156, the illumination device 158, and the lens reflector 160. The lens reflector 160 of FIG. 3 is schematically illustrated to indicate that the output of the illumination device 158 is reflected toward the surface 14 of the drum 12. Other configurations are possible, such as that illustrated in FIG. 4. FIG. 3 also illustrates a cover 162 to be operatively connected to the base portion 140 to provide an enclosure for the imaging circuit 156, the illumination device 158, and the lens reflector 160 in combination with the base portion 140.

The imaging circuit 156 includes a photo-sensing element or array of photo-sensing elements and related electronics connected to and supported for movement by the deck 146. The deck 146 which is configured to move across the surface 14 of the drum 12, moves the imaging circuit 156, including the photo-sensing element(s), across the a portion of or substantially the entire width of the drum in the cross-process direction. In one embodiment, the imaging circuit 156 can be an electronic device including a two dimensional array of photodiodes, for instance an array of 16×16 photodiodes. Other arrays of more or fewer photodiodes can be used, including rectangular arrays of photodiodes. The array of photodiodes can provide an image at a resolution of about 400-800 dots per inch (dpi). In addition, an optical path circuit is operatively connected to the array of photodiodes to provide an electronic signal representative of the images being sensed by the array of photodiodes.

Figure 4:
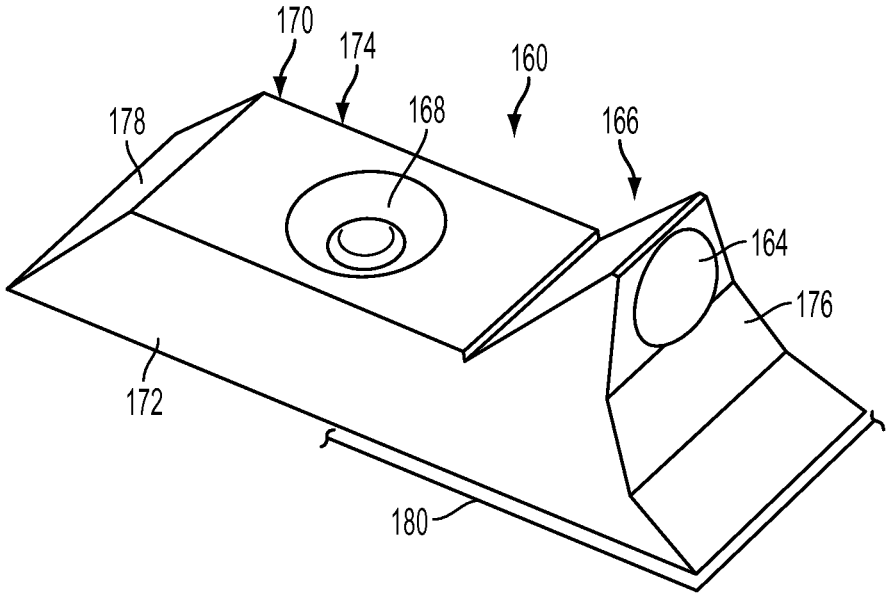
FIG. 4 is a perspective view of a lens reflector.

The imaging circuit 156 can provide image information and location information in response to either an illuminated drum surface or an illuminated ink image deposited on the drum. The drum surface or ink image can be illuminated by the illumination device 158 in combination with the lens reflector 160. While the illumination device 158 can include a light emitting diode (LED), which is illustrated, other sources of illumination can be used. The LED is disposed adjacent to the lens reflector 160 such that the emitted light is directed to a first lens 164 of the lens reflector 160 as illustrated in FIG. 4. The first lens 164 is located at a directing portion 166 of the reflector 160 which is configured to direct the emitted light to the drum surface 14 and/or ink on the drum surface 14. The emitted light is reflected from the surface and/or the ink and directed to the imaging circuit 156 through a second lens 168 disposed in a receiving portion 170 of the lens reflector 160.

As can be seen in FIG. 4, the lens reflector includes side walls 172 and 174 and end walls 176 and 178 to define a chamber having an open end which is disposed adjacent to the drum surface. Each of the walls 172, 174, 176, and 178 include a terminating end defining a plane 180 which is disposed adjacent to the surface. In one embodiment, the plane 180 is approximately five millimeters from the surface 14 of the drum 12. The directing portion 166 extends through an aperture 182 of the circuit board 154 (See FIG. 3) such that the second lens 168 is disposed adjacent to the photodiodes of the imaging circuit 156.

The lens reflector 160 can be made of a single part formed to include the first and second lens 164 and 168 as integral parts. The lens reflector 160 can also be formed of multiple parts including a supporting structure to support individual lenses or a supporting structure formed to include one integral lens and one individual lens. In another embodiment, one or both of the lenses can be eliminated depending on the structure of the lens reflector 160 and the characteristics of the illumination device 158 or the characteristics of the photodiodes of the imaging circuit 156. In addition, while the lens reflector 160 is shown to include a distinct geometry including angled portions or sides at each of the end walls 176 and 178, other configurations are possible.

The photodiode array of the imaging circuit 156 can include an ASIC which can be obtained from a number of vendors and configured to provide an image of the surface 14 of the drum 12 or ink images deposited on the surface 14 as well as the location of the imaging sled 112 on the surface 14. The ASIC can measure small features in or at the surface 14 and output location information, including x and y coordinate information using high speed image processing routines which can be configured as programmed instructions in the controller 80. In addition to providing coordinate information, the sensors can provide a two dimensional image of the surface. Consequently, the imaging circuit 156 can provide information which enables the imaging sled 112 to provide position control information to the controller 80, thereby acting as an encoder, and to provide image information thereby acting as an imager or image generator. The imaging circuit 156 or the circuit board 154 or both can transmit and receive signal information to and from the controller 80 through either a wired connection or a wireless communication such as Wi-Fi, Bluetooth, radio, microwave, infrared or other communication techniques. Because the imaging sled can provide position control information to the controller 80, the described embodiments can operate without a separate position encoder, since ink drop test pattern information imaged by the sensor can act as a position encoder.

While a photodiode array is described for imaging, the imaging circuit can be configured to include a single sensor element, multiple sensor elements, laser sensors, and sensors with built in filters. In one embodiment, the imaging circuit 156 can capture a large number of images on the order of about 1000 image frames/second. The circuit 156 can include built-in electronics which compares these images to each other in order to calculate the distance of movement, i.e., the encoder signals of x/y movement. The ASICs also include serial ports which enable a frame grab at a lower speed (5-10 frame/sec).

A photodiode is a monochrome device which images or sees "light" and outputs a single value which is proportional to the amount of "light" being seen (typically 0-255 value) in a digital system. While photodiodes can detect a wide range of colors, in some instances, filters can be built into the chip and placed over different photodiodes to detect only certain wavelengths of light. In some embodiments, the sensors can have red, green, and blue filters (each with a corresponding photodiode). For instance a red filter transmits only the red wavelengths. When white light illuminates a surface having cyan ink, the photodiode with the red filter would have a very low value, for instance around zero, and the photodiodes with the green and blue filters would have very high values (because the cyan ink lets the green and blue light though). Using white light as an illumination source and three photodiodes with filters enables the imaging circuit to distinguish colors. By distinguishing colors, the imaging sled can provide for color correction and gray balance in the printer. Color correction is the process of mixing inks to create different colors. Gray balance is a type of color correction in which the hue or tint of the gray can be adjusted.

In one embodiment, the imaging circuit 156 or the controller 80, or both, can provide a thresholding algorithm which can be applied to the image being sensed by the photodiode or photodiodes to increase the contrast of the image being sensed. For instance, when the ink image consists of spaced lines printed at an angle with respect to the process direction, the thresholding algorithm can be applied to increase the contrast of the ink lines when compared to the background, which includes the surface 14 of the drum 12 being covered with a release agent. In one thresholding algorithm, darker gray values, for instance those below 100 IUs (intensity units) are the darker pixels which represent an inked line. Values above 100 are lighter background noise, generally the surface of the drum and the release agent, if any. While a single photo element or single photo sensor imaging circuit 156 can generally determine a threshold of 100, multiple photo element or multiple photo sensor arrays can be used to increase the signal to noise ratio.

The imaging circuit 156 can include one or more different types of complementary metal oxide semiconductor (CMOS) chips or microprocessors available from a variety of different vendors. In one embodiment, the selected chip can provide white-color balance in diverse lighting conditions to maintain color consistency of the image. The chip can also include an internal infrared blocking filter that eliminates light source spectral error while measuring light intensity and color like that determined by the human eye. Such sensors can also include an analog to digital (AC/DC) converter built on the chip and thus offer a cost benefit for the electronics when compared to other chips that do not include an AC/DC converter. Such chips can also include the combination of configurable color filtered silicon photodiodes and a current-to-frequency converter on a single CMOS chip.

The illumination device 158 in combination with the lens reflector 160 directs the light to the ink on the surface of the drum 12. In another embodiment, the illumination device can include a multi-colored LED array. By selecting two or more different colors of LEDs, the generated illumination can be used to increase the signal to noise ratio of the different colored inks deposited on the drum. For instance, the absorption characteristics of different types and colors of ink can vary, and consequently, the type of LED can be selected to optimize the characteristics of the reflected image being received by the imaging circuit 156.

For instance, color information can be obtained by using an RGB (red, green, and blue) LED. As an example, the color yellow absorbs blue light. If white light (white contains all the colors) illuminates a yellow material, the yellow material absorbs most of the short (blue) wavelengths and reflects the green through red wavelengths, which is seen as yellow. Consequently, to image yellow ink lines deposited on the drum surface, a blue LED is most effective. Therefore, the yellow lines absorb most of the blue color, which appears as black to the photodiode sensor since little light is returned. The surrounding drum surface reflects the blue wavelengths back to the photodiode(s) and the yellow lines on an aluminum drum appears as black lines on a white background to the photodiode array. A blue LED can be used to image yellow ink, a green LED can be used to image magenta ink, and a red LED can be used to image cyan ink. Therefore, when the different RGB colors are turned on, different CMY colors can be imaged (all as black against white background) on the drum. The color black can be imaged by any of the colors, because black absorbs all wavelengths.

Figure 5:
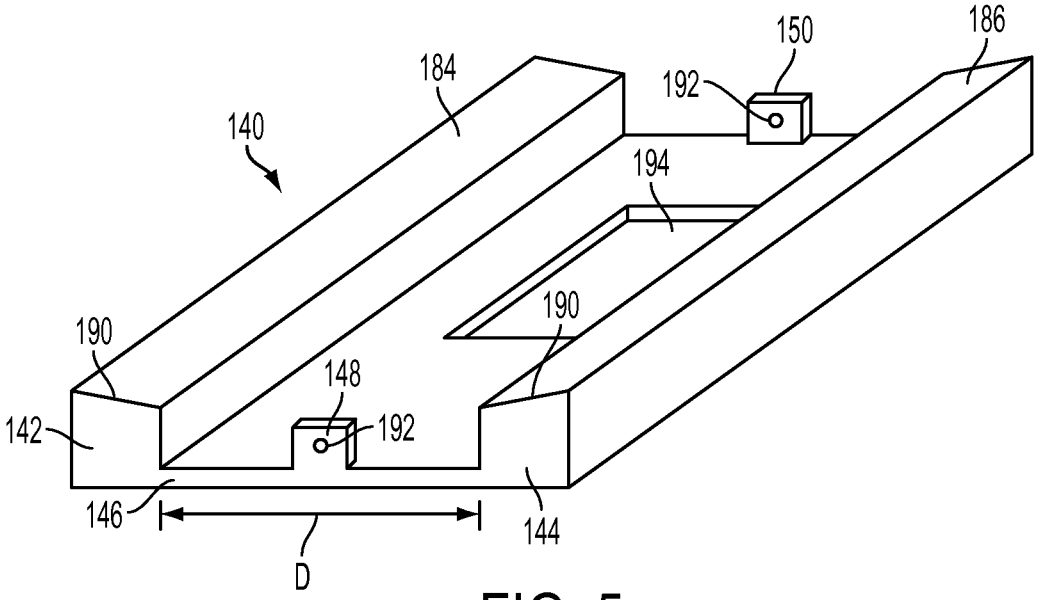
FIG. 5 is a bottom perspective view of a base portion of the imaging sled of FIG. 3.

As previously described, the imaging sled 112 can be positioned off of the drum during a printing operation and to protect the imaging sled 112 from debris such as paper particles, household dust, or ink particles. When needed for scanning, the sled 112 can be moved onto the drum surface 14. Once the sled 112 contacts the drum surface, the sled 112 moves across the surface of the drum on the first runner 142 and the second runner 144 as described above. As further illustrated in FIG. 5 in a bottom perspective view of the base portion 140 of the imaging sled 112, the first runner 142 and the second runner 144 extend away from and along the length the of deck 146. Each of the runners 142 and 144 include a contact surface 184 and 186 respectively, each of which is angled with respect to a plane defined by the deck 146. While the surfaces 184 and 186 are shown at a specific angle for the purposes of illustration, the angle of such surfaces can be generally defined by the radius of the drum surface 14 contacted by the runners 142 and 144. In addition, the leading and trailing edges 190 of the runners 142 and 144 can be rounded, as illustrated in FIG. 3, or angled to reduce the amount of friction generated by the runners 142 and 144 when engaging the surface 14 of the drum 12. In another embodiment, one or more of the runners 142 and 144 can be eliminated and other structures such as wheels can be used to move the imaging sled 112 across the surface 14 of the drum 12. The entire base portion 140 including the runners 142 and 144 can be made of a material having a low coefficient of friction or the surfaces 184 and 186 can be coated with a material having a low coefficient of friction to enable movement of the sled 112 across the surface 14. The contacting portions of the base can be made of many different types of plastic materials including acrylonitrile butadiene styrene (ABS), polytetrafluoroethylene (PTFE) and polycarbonate. The base portion 140 can also be constructed of separate parts.

The geometry of the base and in particular the distance of the deck 146 from the surface 14 of the drum 12 controls the focal distance of the photodiodes with respect to the surface of the drum and the ink images deposited on the drum. In one embodiment, the distance from the photodiodes to the surface 14 is about 5 millimeters. While the height of the runners 142 and 144 measured from the platform 146 can be used to control the spacing of the photodiodes from the surface, the thickness of the platform 146 and the thickness of the circuit board 154 can also determine the focal distance. The selection of a focal distance can also take into account the type of imaging devices incorporated into the imaging circuit 156.

The base portion 140 also includes the first projection 148 and the second projection 150 each of which include an aperture 192. The aperture 192 in defines a hole having a size sufficient to enable the line 118 to be fixed to the imaging sled 112. In one embodiment the line 118 is continuous and extends through each of the apertures 192 and along the length of the base portion 140 to define a continuous loop. In another embodiment, the line 118 terminates at the first projection 148, wraps around pulleys 114 and 116 and terminates at the second projection 150. While projections having apertures are described, the line 118 can be operatively connected to other locations and by other means to the base portion 140. The base portion includes an aperture 194 aligned with the aperture 182 of the circuit board 154 to provide for the location of the lens reflector 160 as previously described.

The first runner 142 and the second runner 144 are spaced a distance D apart. The distance D is selected according to the amount of ink being deposited on the surface 14 of the drum 12 and the size of the ink image. In one ink image, the image extends substantially across the entire width of the drum and extends along the process direction approximately 0.1 to 0.5 inches. In this embodiment the distance D is greater than one quarter of an inch to insure the first runner 142 and the second runner 144 do not contact the ink image during scanning. The first runner 142, the second runner 144, and deck 146 define a passageway or channel such that movement of the imaging sled 112 across the surface 14 of the drum does not contact the ink image during movement.

To image ink deposited on the drum, the imaging sled 112 moves from the location 134 toward the second pulley 116 under control of the motor 122 moving the line 118. As the imaging sled 112 moves across the surface 14 of the drum 12, the imaging sensor 156 provides information of the location of the sled 112 on the surface of the drum in the cross-process direction. Alternatively, the actual ink pattern could be used as feedback for location and speed control. At the same time, the imaging circuit 156 provides image information of the ink deposited on the surface of the drum. Once the imaging sled 112 reaches the side of the drum 12 closest to the pulley 116, the motor 122 reverses direction under control of the controller 80 through rotation of the pulleys 114 and 116 returns the sled 112 across the drum towards the pulley 114. In another embodiment, the pulley 116 is spaced from the end of the drum 12 a sufficient distance to enable the sled 112 to move off of the surface of the drum 12 if necessary.

It will be appreciated that variants of the above-disclosed and other features and functions, or alternatives thereof, can be desirably combined into many other different systems, applications or methods. For instance the described embodiments and teachings can be applied to phase change ink printing systems printing directly to a continuous web or to sheets of recording media. Consequently, various presently unforeseen or unanticipated alternatives, modifications, variations or improvements can be subsequently made by those skilled in the art that are also intended to be encompassed by the following claims.

What is claimed is:

1. A printer comprising:

a rotating image receiving member including a substantially cylindrical outer surface disposed between a first end and a second end;

a printhead disposed adjacent to the image receiving member and configured to form an ink image on the surface thereof;

a movable member, disposed at the first end of the rotating image receiving member and configured to move from the first end to the second end and back to the first end, the movable member being in contact with the surface of the rotating image receiving member during movement from the first end to the second end and the moveable member having a base portion;

a photoelectric sensor, operatively connected to the movable member to enable the base portion of the moveable member to support the photoelectric sensor a predetermined distance from the surface of the image receiving member, the photoelectric sensor configured to receive transmitted light reflected from an ink image, and to convert the reflected transmitted light to a first signal representative of the reflected transmitted light;

an illumination device operatively connected to the base portion of the moveable member and configured to transmit light to the surface of the image receiving member; and a thresholding device operatively connected to the photoelectric sensor and configured to generate a second signal in response to the first signal exceeding a predetermined threshold.

2. The printer of claim 1 further comprising a lens reflector operatively connected to the base portion and disposed adjacent to the illumination device, the lens reflector configured to direct the transmitted light toward the surface of the image receiving member for reflection to the photoelectric sensor.

3. The printer of claim 2 wherein the base portion defines a channel disposed between a first portion and a second portion, the first portion and the second portion being configured to contact the surface of the image receiving member and the channel being configured to include a depth sufficient to be spaced in a non-contacting relationship with an ink image.

4. The printer of claim 3 wherein the first portion and the second portion include a surface configured to form an interface with a curved surface of the image receiving member.

5. The printer of claim 4 wherein the first portion and the second portion include a first runner and a second runner respectively.

6. The printer of claim 1 further comprising a motor, a pulley and a line wherein the line is operatively connected to the pulley and to the movable member, the motor being operatively connected to the line, and the motor being configured to adjust the position of the line to move the movable member across the surface of the image receiving member.

7. The printer of claim 1 wherein the photoelectric sensor includes an array of photosensing elements.

8. The printer of claim 1 wherein the photoelectric sensor includes one of a single sensor element, a multiple sensor element, a laser sensor, and sensor having a filter.

9. The printer of claim 1 wherein the photoelectric sensor includes a sensor configured to detect a phase change ink deposited on the image receiving surface.

10. The printer of claim 1 wherein the illumination device includes a multi-colored light emitting diode.

11. A method of determining the location of an inoperative inkjet nozzle in an offset phase change inkjet printer having a printhead with a plurality of inkjet nozzles depositing ink on an imaging drum having a first end and a second end, the method comprising:

depositing ink on the imaging drum;

scanning the deposited ink with a photoelectric sensor moving in a first direction from the first end to the second end of the imaging drum;

scanning the deposited ink with the photoelectric sensor moving in a second direction from the second end to the first end of the imaging drum; and supporting the photoelectric sensor with a sled having a first contact portion and a second contact portion that contact the imaging drum during the scanning of the deposited ink in the first direction and in the second direction, the first contact portion and the second contact portion being spaced sufficiently apart to substantially avoid contact with the ink deposited on the imaging drum.

* * * * *